US008932021B2

(12) United States Patent
Colson et al.

(10) Patent No.: US 8,932,021 B2
(45) Date of Patent: Jan. 13, 2015

(54) FAN ROTOR FOR AIR CYCLE MACHINE

(75) Inventors: Darryl A. Colson, West Suffield, CT (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 867 days.

(21) Appl. No.: 12/974,114

(22) Filed: Dec. 21, 2010

(65) Prior Publication Data

US 2012/0156043 A1 Jun. 21, 2012

(51) Int. Cl.
*B64C 11/04* (2006.01)
*F04D 29/32* (2006.01)

(52) U.S. Cl.
CPC ..... *F04D 29/329* (2013.01)
USPC ..... 416/204 R

(58) Field of Classification Search
USPC ..... 416/204 R, 205, 207, 209, 214 R, 214 A, 416/204 A, 244
See application file for complete search history.

(56) References Cited

U.S. PATENT DOCUMENTS 1,051,852 A * 1/1913 Treat ..... 415/222
5,113,670 A 5/1992 McAuliffe et al.
5,133,194 A 7/1992 Army, Jr. et al.
5,142,762 A 9/1992 Dziorny et al.
5,249,934 A 10/1993 Merritt et al.
5,309,735 A 5/1994 Maher, Jr. et al.
5,311,749 A 5/1994 McAuliffe et al.
6,151,909 A 11/2000 Carter et al.
2006/0059942 A1 3/2006 McAuliffe et al.
2006/0059943 A1 3/2006 Merritt et al.
2009/0244548 A1 10/2009 Katayama
2009/0274548 A1 * 11/2009 Joco et al. ..... 415/112

* cited by examiner

*Primary Examiner* — Edward Look
*Assistant Examiner* — Maxime Adjagbe
(74) *Attorney, Agent, or Firm* — Carlson, Gaskey & Olds, P.C.

(57) ABSTRACT

A fan rotor includes a rotor body that has plurality of fan blades for rotation about a central axis. An annular wall extends radially inward from the rotor body. A hub body extends axially from the annular wall and defines a central hub bore with a hub bore diameter $D_b$. The hub body further defines a first cylindrical hub portion on one axial side of the annular wall and a second cylindrical hub portion on an opposite side of the annular wall. A ratio of the outer diameter of the first cylindrical hub portion to a diameter of the central hub bore is 1.996-2.007, and a ratio of the second cylindrical hub portion outer diameter to the hub bore diameter is 2.051-2.063.

16 Claims, 3 Drawing Sheets

FAN ROTOR FOR AIR CYCLE MACHINE

BACKGROUND

This disclosure relates to a fan rotor that is incorporated into an air cycle machine. An air cycle machine may include a centrifugal compressor and a centrifugal turbine mounted for co-rotation on a shaft. The centrifugal compressor further compresses partially compressed air, such as bleed air received from a compressor of a gas turbine engine. The compressed air discharges to a downstream heat exchanger or other use before returning to the centrifugal turbine. The compressed air expands in the turbine to thereby drive the compressor. The air output from the turbine may be utilized as an air supply for a vehicle, such as the cabin of an aircraft.

SUMMARY

An example fan rotor includes a rotor body that has plurality of fan blades for rotation about a central axis. An annular wall extends radially inward from the rotor body. A hub body extends axially from the annular wall and defines a central hub bore with a hub bore diameter. The hub body further defines a first cylindrical hub portion on one axial side of the annular wall and a second cylindrical hub portion on an opposite side of the annular wall. A ratio of the outer diameter of the first cylindrical hub portion to the diameter of the central hub bore is 1.996-2.007, and a ratio of the outer diameter of the second cylindrical hub portion to the hub bore diameter is 2.051-2.063.

In another aspect, the fan rotor may be incorporated into an air cycle machine that has main shaft with a compressor rotor and a turbine rotor mounted for rotation thereon. A thrust shaft is mounted on the main shaft and has a shaft body that defines a disk at a first end and a cylindrical shaft portion that extends from the disk to a second end. The shaft body has a shaft bore which defines a shaft bore diameter $D_s$. A ratio of the outer diameter of the first cylindrical hub portion of the hub body to the shaft bore diameter is 1.002-1.007.

An exemplary method of installing the fan rotor on the air cycle machine includes extending the main shaft through the central hub bore, inserting the first cylindrical hub portion into the shaft bore of the thrust shaft, and securing a nut on the main shaft to secure the main shaft, thrust shaft, and fan rotor together for co-rotation with the compressor rotor and the turbine rotor.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
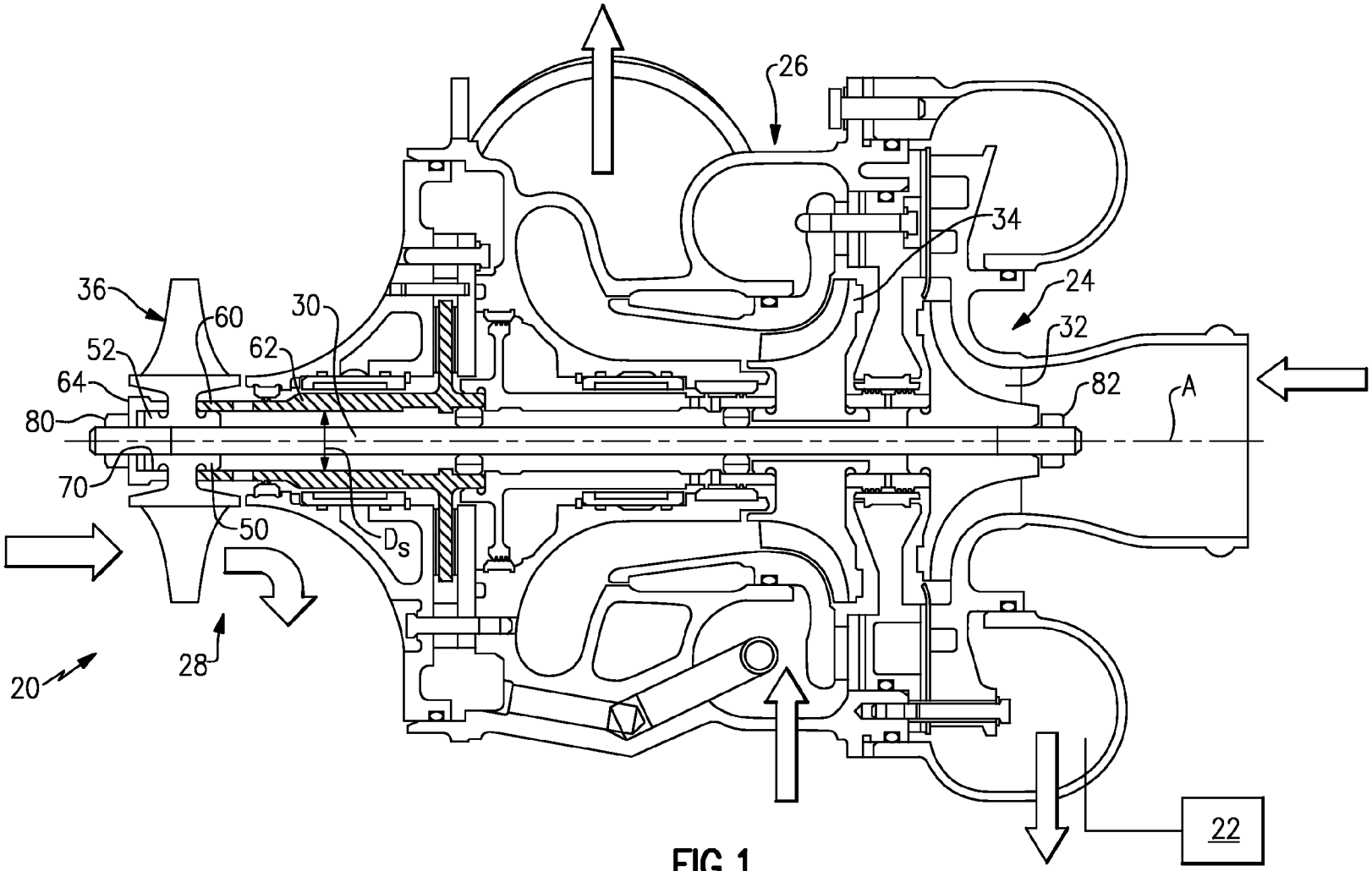
FIG. 1 illustrates an example air cycle machine.

FIG. 1 shows an example air cycle machine 20 ("ACM") that is incorporated into an air supply system 22 of a vehicle, such as an aircraft, helicopter, or land-based vehicle. The ACM 20 includes a compressor section 24, a turbine section 26 and a fan section 28 that are generally disposed about a main shaft 30, such as a tie rod. The compressor section 24 includes a compressor rotor 32, the turbine section 26 includes a turbine rotor 34, and the fan section 28 includes a fan rotor 36. The compressor rotor 32, turbine rotor 34, and fan rotor 36 are secured on the main shaft 30 for co-rotation about an axis A.

Figure 2A:
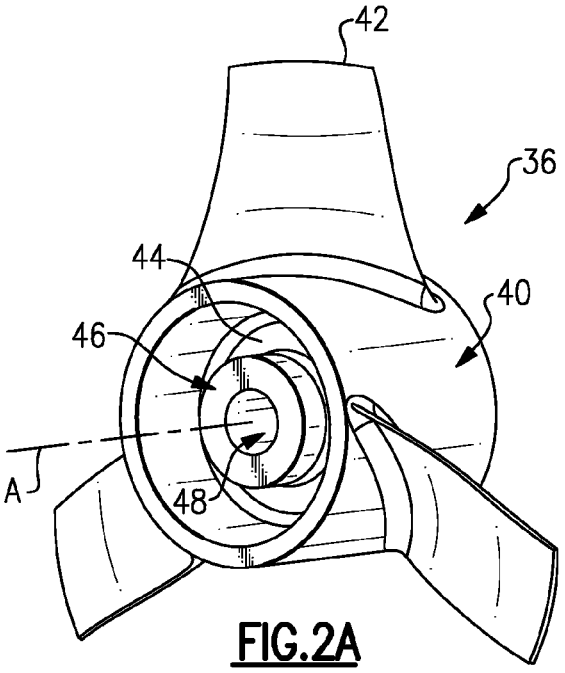
FIG. 2A illustrates a perspective view of a fan rotor.
Figure 2B:
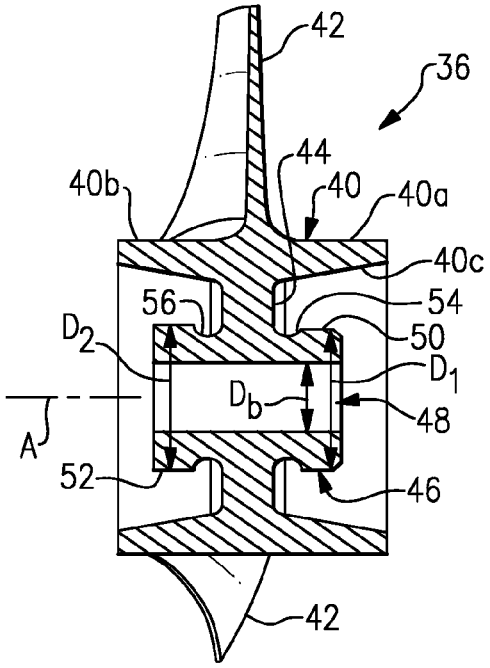
FIG. 2B illustrates a cross-sectional view of the fan rotor of FIG. 2A.

Referring also to the perspective view of the fan rotor 36 shown in FIG. 2A and the cross-sectional view of the fan rotor 36 shown in FIG. 2B, the fan rotor 36 includes a rotor body 40 that has a plurality of fan blades 42 for rotation about the central axis A. The rotor body 40 defines a radially inwardly extending annular wall 44 that meets a hub body 46 at its radially inward end.

A first body portion 40*a* extends axially (to the right in FIG. 2B) at a radially outer end of the annular wall 44. A second body portion 40*b* extends axially (to the left in FIG. 2B) at the radially outer end of the annular wall 44. The rotor body 40 thereby defines a generally cylindrical outer peripheral surface. An inside surface 40*c* of the rotor body 40 is generally frustoconical and the radial thickness of the rotor body 40 is thereby non-uniform as a function of axial position.

The hub body 46 extends axially from the annular wall 44 and defines a central hub bore 48 with a hub bore diameter $D_b$. The hub body 46 further defines a first cylindrical hub portion 50 that extends around the central hub bore 48 on one axial side (the right side in FIG. 2B) of the annular wall 44 and a second cylindrical hub portion 52 that extends around the central hub bore 48 on an opposite axial side (the left side in FIG. 2B) of the annular wall 44. The first cylindrical hub portion 50 defines a first outer diameter $D_1$ and the second cylindrical hub portion 52 defines a second outer diameter $D_2$.

Figure 2C:
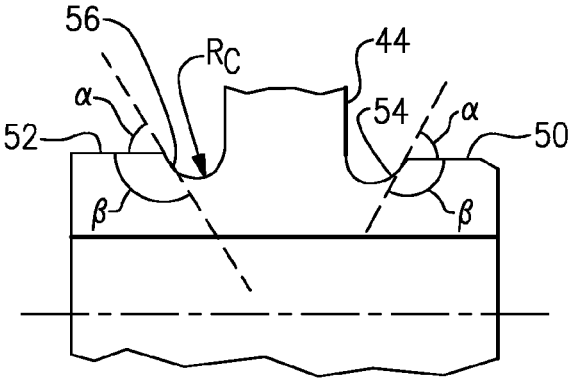
FIG. 2C illustrates a portion of the hub body of the fan rotor illustrated in 2B.

As shown also in FIG. 2C, the hub body 46 additionally includes a first circumferential groove 54 and a second circumferential groove 56. The first circumferential groove 54 is located axially between the first cylindrical hub portion 50 and the annular wall 44. The second circumferential groove 56 is located axially between the second cylindrical hub portion 52 and the annular wall 44. Each of the circumferential grooves 54 and 56 define a radius of curvature $R_c$. In an embodiment, the radii of curvature $R_c$ are equal between the circumferential grooves 54 and 56.

Each of the circumferential grooves 54 and 56 generally has a semi-circular cross-section that extends on one side of the semi-circle from the annular wall 44, to the valley of the semi-circle, and then meets the outer peripheral surface of the respective first cylindrical hub portion 50 or second cylindrical hub portion 52. The surface that defines each of the circumferential grooves 54 and 56 meets the outer peripheral surface of the corresponding cylindrical hub portions at an angle beta (β). The angle beta may be taken between the tangent line of the surface of the groove and the peripheral surface. The angle alpha (α) is the compliment of the angle beta. Therefore, the surfaces of the circumferential grooves 54 and 56 meet the outer peripheral surface of the corresponding cylindrical hub portion 50 or 52 at the complimentary angle alpha.

The fan rotor 36 is mounted onto the main shaft 30 such that the first cylindrical hub portion 50 is received into a cylindrical shaft portion 60 of a thrust shaft 62. The thrust shaft 62 includes a shaft bore defining a shaft bore diameter $D_s$. The cylindrical shaft portion 60 is located at one end of the thrust shaft 62, opposite from the other end which includes a disk that extends radially relative to central axis A.

Figure 3A:
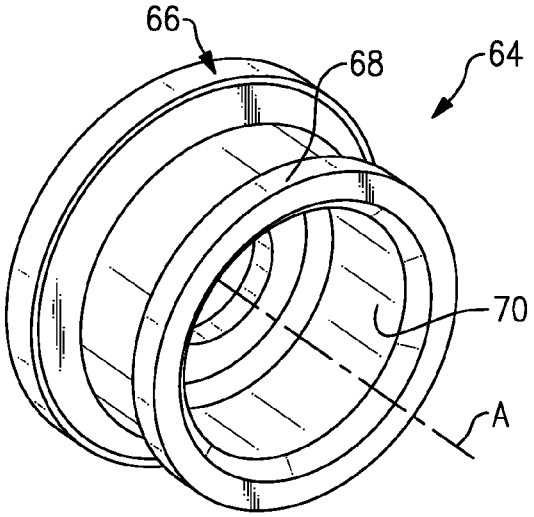
FIG. 3A illustrates a perspective view of a fan rotor ring.
Figure 3B:
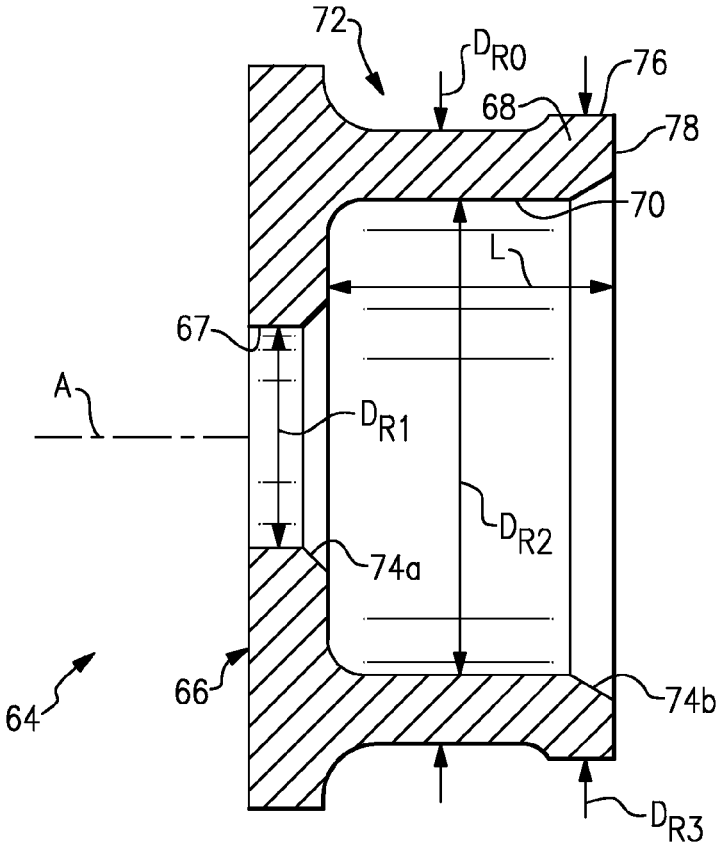
FIG. 3B illustrates a cross-sectional view of the fan rotor ring of FIG. 3A.

FIG. 3A and FIG. 3B show a fan rotor ring 64 that is coupled with the fan rotor 36 as depicted in FIG. 1 on the opposite side from the thrust shaft 62. The fan rotor ring 64 includes a ring body 66 that defines a main bore 67 having a main bore diameter $D_{R1}$ along central axis A. An annular flange 68 extends axially from the ring body 66 over a length L and defines a fan ring bore 70 having a fan ring bore inner diameter $D_{R2}$. The annular flange 68 includes a circumferential groove 72, which defines an outer diameter $D_{R0}$. The main bore 67 and the fan ring bore 70 include chamfer edges 74*a* and 74*b*, respectively. In one embodiment, at least one of the chamfer edges may define an angle with the central axis A that is 28-32 degrees. The angle may nominally be 30 degrees. A free end 76 of the annular flange 68 may be enlarged and define an outer diameter $D_{R3}$. In embodiments, $D_{R3}$ may be 0.745-0.755 inches (1.892-1.918 centimeters). An axial face 78 of the annular flange may be up to 0.01 inches (0.0254 centimeters) in radial thickness.

Once assembled together, the fan rotor ring 64, fan rotor 36, and thrust shaft 62 are secured using a nut 80 (FIG. 1) that cooperates with another nut 82 at the opposite end of the ACM 20 to rigidly secure the fan rotor 36 and thrust shaft 62 together for co-rotation with the compressor rotor 32 and turbine rotor 34. That is, the fan rotor 36 and thrust shaft 62 operate as a unitary rigid object, which facilitates the reduction of imbalance and dynamic issues that could otherwise arise.

A tight fit is provided between the first cylindrical hub portion 50 of the fan rotor 36 and the cylindrical shaft portion 60 of the thrust shaft 62 to achieve a desirable interference press-fit and establish minimal stresses on the components at all operating conditions of the ACM 20. An improper fit may hinder assembly of the fan rotor 36 onto the main shaft 30 and into the thrust shaft 62. The fan rotor 36 provides a proper fit according to the ratios described below.

In embodiments, the outer diameter $D_1$ of the first cylindrical hub portion 50 of the hub body 56 is 0.5438-0.5450 inches (1.381-1.384 centimeters) and nominally may be 0.5444 inches (1.383 centimeters). In embodiments, the outer diameter $D_2$ of the second cylindrical hub portion 52 is 0.5588-0.5600 inches (1.419-1.422 centimeters) and may nominally be 0.5594 inches (1.421 centimeters). In embodiments, the diameter $D_b$ of the central hub bore 48 is 0.2715-0.2725 inches (0.6896-0.6922 centimeters) and may nominally be 0.2720 inches (0.6909 centimeters).

In one example, a ratio $D_1/D_b$ is selected to be 1.996-2.007 and a ratio $D_2/D_b$ is selected to be 2.051-2.063. For instance, the disclosed ratios ensure that the hub body 46 can withstand the design stresses applied during operation of the ACM 20 and ensure a proper fit with the mating components of the ACM 20.

In embodiments, the fan ring bore inner diameter $D_{R2}$ is 0.5564-0.5576 inches (1.413-1.416 centimeters) and nominally may be 0.5570 inches (1.415 centimeters). In embodiments, a ratio $D_1/D_s$ is 1.002-1.007. In a further example, a ratio $D_2/D_{R2}$ is 1.002-1.007. For instance, the selected ratios for $D_1/D_s$ and $D_2/D_{R2}$ provide a proper, tight fit between the fan rotor 36 and the respective thrust shaft 62 and fan rotor ring 64 to ensure that the fan rotor 36 and thrust shaft 62 function as a unitary rigid body.

In embodiments, the angle alpha is 58-62 degrees and may nominally be 60 degrees. In embodiments, the radii of curvature $R_c$ of the circumferential grooves 54 and 56 are 0.45-0.55 inches (1.14-1.40 centimeters) and may nominally be 0.50 inches (1.27 centimeters). In some embodiments, a ratio of the angle alpha/$R_c$ is 1055-1378 degrees per inch to provide a desirable degree of strength to the joint between the hub body 46 and the annular wall 44.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A fan rotor comprising:

a rotor body having a plurality of fan blades for rotation about a central axis and a radially inwardly extending annular wall; and a hub body extending axially from the annular wall and defining a central hub bore with a hub bore diameter $D_b$, the hub body further defining a first cylindrical hub portion around the central hub bore on one axial side of the annular wall and a second cylindrical hub portion around the central hub bore on an opposite axial side of the annular wall, the first cylindrical hub portion defining a first outer diameter $D_1$ and the second cylindrical hub portion defining a second outer diameter $D_2$, where a ratio $D_1/D_b$ is 1.996-2.007 and a ratio $D_2/D_b$ is 2.051-2.063;

wherein the hub body includes a first circumferential groove located between the first cylindrical hub portion and the annular wall, and a second circumferential groove located between the second cylindrical hub portion and the annular wall.

2. The fan rotor as recited in claim 1, wherein each of the first circumferential groove and the second circumferential groove define a radius of curvature $R_c$ and meet an outer peripheral surface of the respective first cylindrical hub portion or second cylindrical hub portion at a complimentary angle alpha ($\alpha$) such that a ratio alpha/$R_c$ is 1055-1378 degrees per inch.

3. The fan rotor as recited in claim 1, wherein the first circumferential groove and the second circumferential groove each have a semi-circular cross-section.

4. The fan rotor as recited in claim 1, wherein the first cylindrical hub portion includes a chamfer.

5. The fan rotor as recited in claim 1, wherein the rotor body includes an axially extending wall having a cylindrical outer surface and defining a non-uniform radial thickness.

6. The fan rotor as recited in claim 1, wherein the rotor body defines a first rotor body portion that extends axially at a radially outer end of the annular wall.

7. An air cycle machine comprising:

a main shaft having a compressor rotor and a turbine rotor mounted for rotation thereon;

a thrust shaft mounted on the main shaft, the thrust shaft having a shaft body defining a disk at a first end and a cylindrical shaft portion extending from the disk to a second end, the shaft body having a shaft bore defining a shaft bore diameter $D_s$; and a fan rotor mounted on the cylindrical shaft portion and including:

a rotor body having a plurality of fan blades for rotation about a central axis and a radially inwardly extending annular wall; and a hub body extending axially from the annular wall and defining a central hub bore with a hub bore diameter $D_b$, the hub body further defining a first cylindrical hub portion around the central hub bore on one axial side of the annular wall which is received into the shaft bore of the thrust shaft and a second cylindrical hub portion around the central hub bore on an opposite axial side of the annular wall, the first cylindrical hub portion defining a first outer diameter $D_1$ such that a ratio $D_1/D_s$ is 1.002-1.007;

wherein the hub body includes a first circumferential groove located between the first cylindrical hub portion and the annular wall, and a second circumferential groove located between the second cylindrical hub portion and the annular wall.

8. The air cycle machine as recited in claim 7, further comprising a fan rotor ring that is mounted over the second cylindrical hub portion of the hub body, the fan rotor ring having a fan ring bore with a fan ring bore diameter $D_{R2}$, and the second cylindrical hub portion defining a second outer diameter $D_2$ such that a ratio $D_2/D_{R2}$ is 1.002-1.007.

9. The air cycle machine as recited in claim 7, wherein the second cylindrical hub portion defines a second outer diameter $D_2$ such that $D_2/D_b$ is 2.051-2.063.

10. The air cycle machine as recited in claim 7, wherein a ratio $D_1/D_b$ is 1.996-2.007.

11. The air cycle machine as recited in claim 7, wherein each of the first circumferential groove and the second circumferential groove define a radius of curvature $R_c$ and meet an outer peripheral surface of the respective first cylindrical hub portion or second cylindrical hub portion at a complimentary angle alpha ($\alpha$) such that a ratio alpha/$R_c$ is 1055-1378 degrees per inch.

12. The air cycle machine as recited in claim 7, wherein the first circumferential groove and the second circumferential groove each have a semi-circular cross-section.

13. A method of installing a fan rotor on an air cycle machine, the method comprising:

extending a main shaft having a compressor rotor and a turbine rotor mounted for rotation thereon through a central hub bore of a fan rotor that includes:

a rotor body having a plurality of fan blades for rotation about a central axis and a radially inwardly extending annular wall; and a hub body extending axially from the annular wall and defining the central hub bore with a hub bore diameter $D_b$, the hub body further defining a first cylindrical hub portion around the central hub bore on one axial side of the annular wall and a second cylindrical hub portion around the central hub bore on an opposite axial side of the annular wall, the first cylindrical hub portion defining a first outer diameter $D_1$ and the second cylindrical portion defining a second outer diameter $D_2$;

inserting the first cylindrical hub portion of the fan rotor into a shaft bore of a cylindrical shaft portion of a thrust shaft that is mounted on the main shaft, the thrust shaft having a shaft body defining a disk at a first end and the cylindrical shaft portion extending from the disk to a second end, the shaft bore having a shaft bore diameter $D_s$ such that a ratio $D_1/D_s$ is 1.002-1.007;

securing a nut on the main shaft to secure the main shaft, thrust shaft, and fan rotor together for co-rotation with the compressor rotor and the turbine rotor;

wherein the hub body includes a first circumferential groove located between the first cylindrical hub portion and the annular wall, and a second circumferential groove located between the second cylindrical hub portion and the annular wall.

14. The method as recited in claim 13, further comprising, prior to securing the nut on the main shaft, inserting a fan rotor ring on the fan rotor by inserting the second cylindrical hub portion of the hub body into a fan ring bore of the fan rotor ring, the fan ring bore having a fan ring bore diameter $D_{R2}$ such that a ratio $D_2/D_{R2}$ is 1.002-1.007.

15. The method as recited in claim 13, wherein each of the first circumferential groove and the second circumferential groove define a radius of curvature $R_c$ and meet an outer peripheral surface of the respective first cylindrical hub portion or second cylindrical hub portion at a complimentary angle alpha ($\alpha$) such that a ratio alpha/$R_c$ is 1055-1378 degrees per inch.

16. The method as recited in claim 13, wherein the first circumferential groove and the second circumferential groove each have a semi-circular cross-section.

* * * * *